United States Patent [19]

Hess et al.

[11] 4,014,661

[45] Mar. 29, 1977

[54] FUEL MAKING PROCESS

[75] Inventors: Howard V. Hess, Glenham; William F. Franz, Gardiner; Edward L. Cole, Fishkill, all of N.Y.

[73] Assignee: Texaco Inc., New York, N.Y.

[22] Filed: Mar. 17, 1975

[21] Appl. No.: 558,870

[52] U.S. Cl. ..... 44/51; 201/2.5; 201/25; 208/8; 210/63 R

[51] Int. Cl.[2] ..... C10L 1/32

[58] Field of Search ..... 201/2.5, 25, 63; 44/51; 208/8

[56] References Cited

UNITED STATES PATENTS

| | | | |
|---|---|---|---|
| 1,623,241 | 4/1927 | Greenstreet | 44/51 |
| 1,647,471 | 11/1927 | Plauson et al. | 44/51 |
| 3,241,505 | 3/1966 | Long et al. | 44/51 |
| 3,520,067 | 7/1970 | Winegartner | 208/8 |
| 3,671,403 | 6/1972 | Hess et al. | 210/63 |
| 3,740,332 | 6/1973 | Cole et al. | 210/63 |

*Primary Examiner*—Daniel E. Wyman
*Assistant Examiner*—Mrs. Y. Harris-Smith
*Attorney, Agent, or Firm*—Thomas H. Whaley; Carl G. Ries; Henry W. Archer

[57] ABSTRACT

Disclosed is a process for making a hydrocarbon coke slurry fuel by coking carbonaceous materials in the liquid phase under autogenous pressure to form coke which is then extracted with a combustible hydrocarbon at high temperatures and pressures to produce a dense slurry of coke in the hydrocarbon suitable for use as a fuel.

5 Claims, 1 Drawing Figure

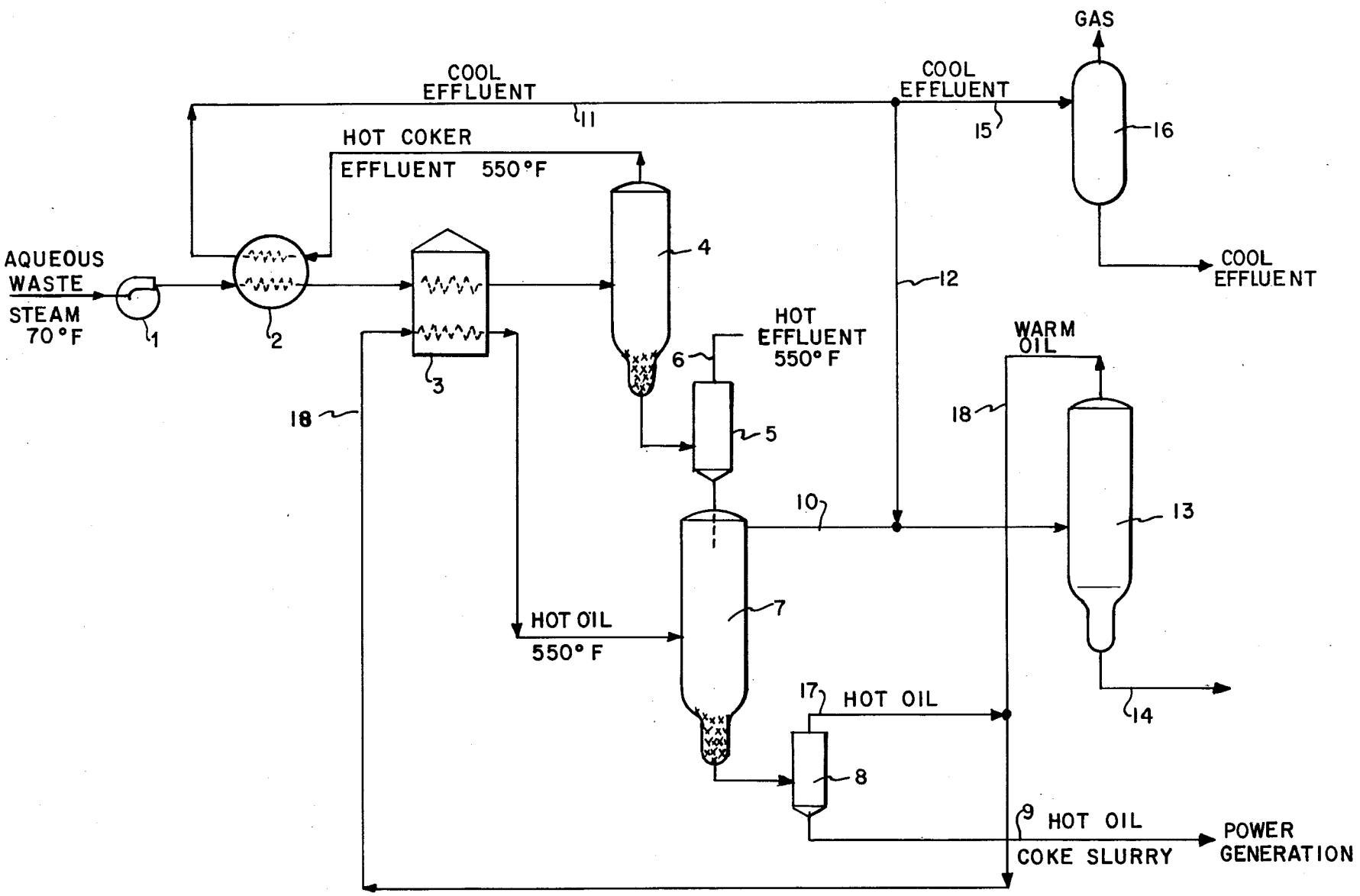
GAS
16
COOL EFFLUENT
COOL EFFLUENT
15
12
WARM OIL
18
13
14
POWER GENERATION
HOT OIL
COKE SLURRY
9
HOT OIL
17
8
HOT EFFLUENT 550°F
10
5
6
7
4
11
COOL EFFLUENT
HOT COKER EFFLUENT 550°F
HOT OIL 550°F
3
18
2
1
AQUEOUS WASTE
STEAM 70°F

FUEL MAKING PROCESS

BACKGROUND OF THE INVENTION

1. Field of the Invention

This invention relates to a process for making a coke-containing fuel. More particularly, the invention relates to a process wherein coke is extracted from the products of a cooking process by means of a hydrocarbon which also has caloric value and forms part of the fuel produced.

2. Description of the Prior Art

In coassigned U.S. Pat. Nos. 3,507,788; 3,595,742 and 3,705,077 are described embodiments of a process for coking carbonaceous materials in the liquid phase substantially in the absence of free oxygen by heating the materials to a temperature in the range of 400° to 700° F at a pressure in the range of 300 to 3200 psig for a period of 0.5 minutes to 2 hours to form gases and a water insoluble liquor-containing coke.

After separation from the liquor, the coke is wet with 50 to 90 weight percent of water. Practical considerations require that this coke be water-free before it can be used.

THE INVENTION

This invention will be better understood by reference to the accompanying drawing which illustrates diagrammatically a preferred embodiment of the present invention.

In the present process, the parameters of pressure, temperature and time set forth above in connection with the description of the basic process are applicable but with the addition of a hot hydrocarbon-water extraction step with the hydrocarbon remaining at least partially in the product fuel.

Referring to the drawing, an aqueous waste stream containing carbonaceous materials is pumped up to pressure by pump 1 to around 1100 psig and through heat exchanger 2 where it is in heat exchange with hot coker effluent at for example, 550° F and 1100 psig. In heat exchanger 2, the incoming waste stream is heated and the hot coker effluent cooled to around 470° and 150° F but preferably 90° F. The preheated waste stream is then flowed through fired heater 3 where the temperature is raised to 550° F and then into coke drum 4 where the coke settles to the bottom. The hot coker effluent is withdrawn and sent to heat exchanger 2. Vessel 4 is operated at around 550° F and 1100 psig. A coke water slurry is blown down under pressure to liquid-solid cyclone 5 where the solids are concentrated and the overflow hot coker effluent is produced in line 6. The concentrated solids from cyclone 5 are discharged into vessel 7 where they are dried by extraction with hot oil at a temperature of between 400° and 700° F but preferably at 550° F and 1100 psig. The dried coke falls to the bottom of vessel 7 and is withdrawn through liquid-solid cyclone 8 and finally withdrawn as underflow from cyclone 8 as a dense slurry of dry coke in oil through line 9. This hot slurry of coke in oil can be used for power generation. Optionally a part of this stream may be used to fire heater 3.

The oil-water solution at 550° F passes from the top of vessel 7 through line 10 and is mixed with an equal amount of cool effluent at 90° F from line 11 through line 12. This cools the hot oil-water solution to 320° F and effects phase separation in separator 13. Water at 320° F passes from the bottom of separator 13 and may be discharged through line 14 or may optionally be combined with hot effluent from line 6 to produce a hot water stream useful for space heating (etc) which, after use and now cool, can be combined with the cool effluent in line 15 which is finally sent to the gas liquid separator before discharge. Any malodorous gases which might be produced in gas liquid separator 16 can be burned in fired heater 3.

The warm oil from separator 13 and line 18 is combined with the hot oil from cyclone 8 and line 17 and passes to the fired heater 3 through line 18 for recycle to the water extractor system.

The system shown produces an aqueous effluent from the plant which is greatly reduced in BOD (70–80% reduction). This can be further reduced by air oxidizing the hot effluent from the coker (prior to heat exchange) to reduce the BOD to substantially zero. A hot pumpable slurry of coke in oil is produced which can be burned for power generation.

Cokes produced from many waste streams by the instant process are quite low in sulfur and hence non-polluting as shown below.

| Coke Source | Dry Coke Yield | % Sulfur |
|---|---|---|
| Raw Sewage Sludge | 2.0 | 0.4 |
| Potato Waste | 0.9 | 0.1 |
| Orange Waste | 4.1 | 0.1 |
| Whey Liquid | 2.0 | 0.43 |
| Cow Manure | 7.9 | 0.18 |

Cokes produced from waste liquid from wood pulping generally contain considerably sulfur. In these cases, stack gas cleanup for $SO_2$ would have to be practiced.

The wet coke production resulting from practice of this process will range from 5–20% of the sewage feed. Thus the loop in which the water extraction is carried out is relatively small with respect to the total system. If a heavy gas oil were used as the extractant at 550° F and system pressure there is a water solubility in the gas oil of about 7 wt. %. If kerosine were used there is about 10 wt. % water solubility in the kerosine. Other hydrocarbons suitable in the practice of the invention include cracked distillates, light and intermediate cycle gas oils from catalytic cracking, vacuum gas oils, raffinates from extraction of reformed naphthas and aromatic extracts.

Generally, these oils should have an API gravity of 18°–40° API.

What is claimed is:

1. A process for producing a coke-containing fuel, comprising coking a carbonaceous material in the liquid phase under a pressure of 300 to 3200 psig at a temperature of 400° to 700° F for 0.5 minutes to 3 hours to form gases, hot liquid and liquid-containing coke; separating said coke from said liquid and gases; drying said coke by extraction with a combustible hydrocarbon under a pressure of between 300 and 3200 psig at a temperature of between 400° and 700° F to remove said liquid from said coke and form a hydrocarbon solution of water and a dense slurry of dry coke in said hydrocarbon suitable for burning.

2. The process as in claim 1, including the further steps of cooling said hydrocarbon solution by heat exchange with cooled liquid from said coking to form a water phase and a hydrocarbon phase and recycling said hydrocarbon phase for reuse as an extractant.

3. The process as in claim 1, including the further step of preheating said carbonaceous material with said hot liquid.

4. The process of claim 1, wherein said hydrocarbon has an API gravity of 18 to 40.

5. The process of claim 1 wherein said hydrocarbon is selected from the group of cracked distillates, vacuum gas oils, light and intermediate cycle oils, raffinates from the extraction of reformed naphthas and aromatic extracts.

* * * * *